US008769849B1

(12) United States Patent
McCombs

(10) Patent No.: US 8,769,849 B1
(45) Date of Patent: Jul. 8, 2014

(54) DEVICE FOR TABLE SETTINGS

(76) Inventor: Karen McCombs, New City, NY (US)

( * ) Notice: Subject to any disclaimer, the term of this patent is extended or adjusted under 35 U.S.C. 154(b) by 284 days.

(21) Appl. No.: 12/802,572

(22) Filed: Jun. 9, 2010

Related U.S. Application Data

(63) Continuation-in-part of application No. 11/287,983, filed on Nov. 28, 2005, now abandoned.

(51) Int. Cl.
*A47G 19/02* (2006.01)

(52) U.S. Cl.
USPC ..... 40/324; 220/574; 428/13

(58) Field of Classification Search
None
See application file for complete search history.

(56) References Cited

U.S. PATENT DOCUMENTS 2,224,683 A * 12/1940 Knox et al. ..... 40/324
5,729,922 A * 3/1998 Peterson et al. ..... 40/324
2009/0291273 A1* 11/2009 Canales ..... 428/195.1

* cited by examiner

*Primary Examiner* — Jack W. Lavinder
(74) *Attorney, Agent, or Firm* — Michael E. Zall

(57) ABSTRACT

An interchangeable themed system for plates of all types. A race is provided within a plate and member releasably disposed within the race and having a decorative upper visible surface. The groove is arranged as a border for framing or setting off the particular table setting element. Opposed exterior surfaces of the member are decorated so as to establish a predetermined theme. The member is so dimensioned as to fit flush with the exposed surface of the dish in which it is installed to present the appearance of being integrally formed with the dish or other table setting.

4 Claims, 7 Drawing Sheets

DEVICE FOR TABLE SETTINGS

CROSS-REFERENCE TO RELATED APPLICATION

This application is a continuation-in-part of application Ser. No. 11/287,983, filed Nov. 28, 2005 now abandoned.

BACKGROUND

1. Field of the Invention

This invention is directed to a device for use in conjunction with and as part of a table setting.

2. Description of Related Art

Table settings are often decorated for festive celebrations or formal affairs. It is well known, for example, to use themes celebrating such holidays as Halloween, Thanksgiving, Christmas, and the like or to provide decorative dishes to enhance the dining experience. It is also known to generally decorate cups and plates, and in particular those made of paper, with holiday designs. Wang, in U.S. Pat. No. 5,967,307, shows design elements which may be releasably attached to a cup so as to change the cups general appearance. Reisman in U.S. Pat. No. 4,836,363, shows the releasably attaching of a decorative packing ring to the outer edge of a flat shipping plate. However, in order to use the plate taught by Reisman it is necessary to cover the decorated plate with a plastic sheet or the like. The function of the decorative ring is principally for protecting articles while in shipment.

These and similar decorative members combined with dishes, glasses, and mugs are believed to be novelty items which, while having an entertaining appearance, are not truly suitable for use in the context of a dining experience.

BRIEF SUMMARY

A device is provided which comprises a plate. The plate has a groove within the exposed upper surface of the plate. a removable member is so dimensioned as to fit within the groove and substantially flush with the upper surface of the plate so as to give the appearance of being an integral and unitary part of the plate. The removable member exposed surface has indicia thereon which is visible when positioned in the groove such that the member visually appears as an integral part of the plate.

The device has other features which may include all or some of the following. The removable member comprises upper and lower opposed surfaces. The removable member is opaque and resistant to bending or permanently deformed. The removable member comprises an upper part and a lower part permanently affixed to one another. The lower portion comprises plastic. The plate is a substantially circular; the groove forms a border adjacent and uniformly spaced from the outer marginal edge of the plate. The dish is a substantially rectangular plate; the groove forms a border being adjacent and uniformly spaced from the outer marginal edge of the plate. The dish is a bowl and the groove forms a border within the bowl and adjacent and uniformly spaced from the outer marginal edge of the bowl. The plate is a substantially circular plate and the groove forms a border being adjacent and uniformly spaced from the outer marginal edge of the plate. The plate is a substantially rectangular plate and the groove forms a border being adjacent and uniformly spaced from the outer marginal edge of the plate.

In another aspect there is provided a device which comprises a plate having therein a race of predetermined dimensions. A member of predetermined dimensioned is removable and snugly disposed within the race. The member within the race having an upper surface continuous with the upper surface of plate such that the upper surface of the member is continuous with the upper surface of the plate.

The device may have any one or combination of the following. The race is disposed proximate the outer edge of the plate. The member has indicia thereon on the side continuous with the upper surface of the plate when the member is disposed in the race. The race defines an outer border of the plate. The member has opposed indicia bearing surfaces spaced by a relative thin edge of the plate. The member upon being disposed within the race forms a border which extends substantially to the outer edge of the plate. The plate is a plate. The race is defined by a planar base wall within the plate two opposed inner and outer side walls extending upwardly from the base wall. The outer side wall defines the outer marginal edge of the plate. One side wall of the race is equal height from the bottom wall as the other side wall of the race and the member such that the outer surfaces from the outer wall, the member and the plate are continuous The outer wall is of greater height than the inner wall such that with the member disposed within the race, the outer wall defines an upper lip. The plate has a circular configuration and the member is an annulus.

BRIEF DESCRIPTION OF THE SEVERAL VIEWS OF THE DRAWING

The devices and systems described in the drawings in which.

DETAILED DESCRIPTION

Design themes for table settings are well known. Dishes are provided with decorations and these decorations are known to be selected to match decorations on table cloths, napkin holders, table cloths and the like. The system discussed here is a convenient means of changing the design themes of table settings while always using the same dishes.

Figure 1:
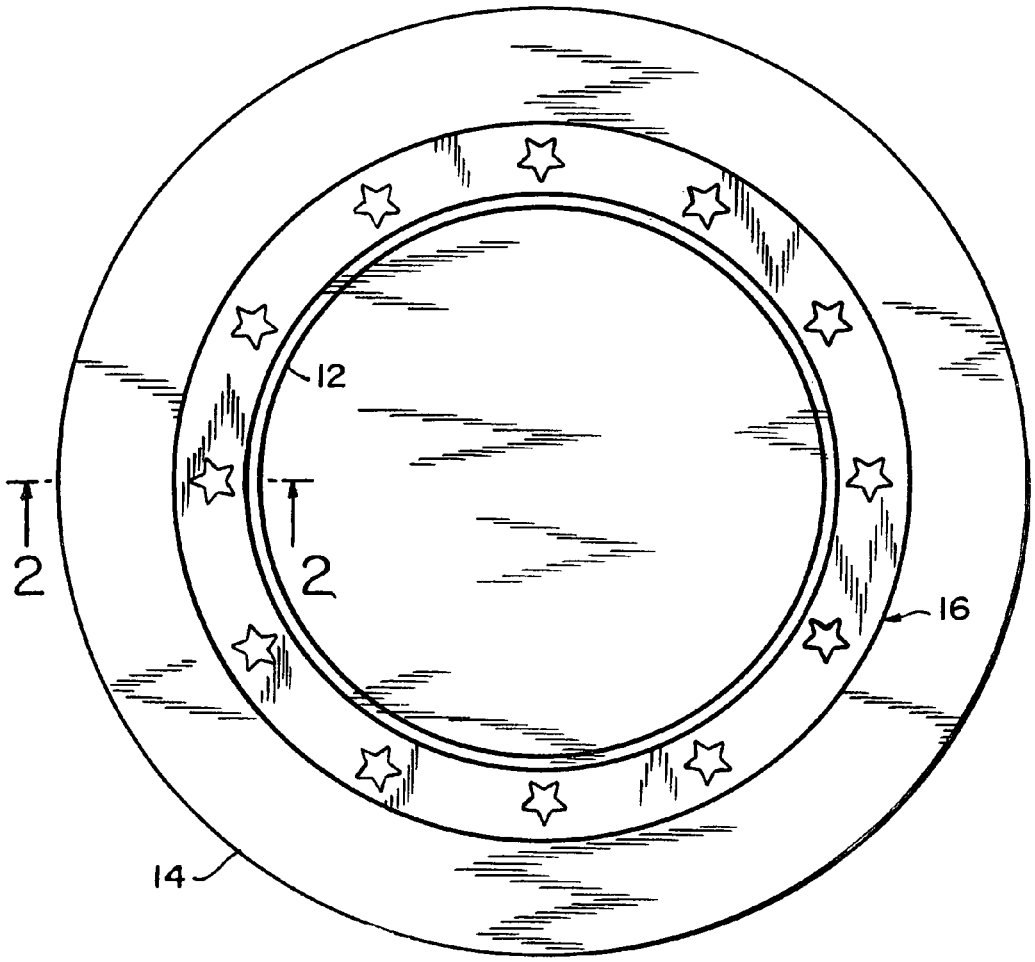
FIG. 1 is a top plan view of a plate.

Turning to the drawing, FIG. 1 shows a dish 10. The term 'dish' as used herein adopts the definition "1 a: a large shallow more or less concave vessel (as a platter) in which food is brought to the table for serving; broadly: any open vessel (as a tureen) similarly used <a deep vegetable dish>" *The American Heritage dictionary of the English Language* (Houghton Mifflin Co. 3d ed., 2000).

In one example there may be a plate 10. The plate 10 may be made of any material from which dishes are commonly made (e.g., china or plastic). The plate 10 may be made in any well known method and is formed with a continuous groove 12. The groove 12 is shown proximate but spaced from the outer marginal edge 14 of the plate 10. However, the groove 12 may be discontinuous and/or formed in other locations on the plate 10. For example, the groove 12 may be located closer to or within the portion of the plate 10 where one eats. Also, the groove 12 may have any desired width.

Figure 2:
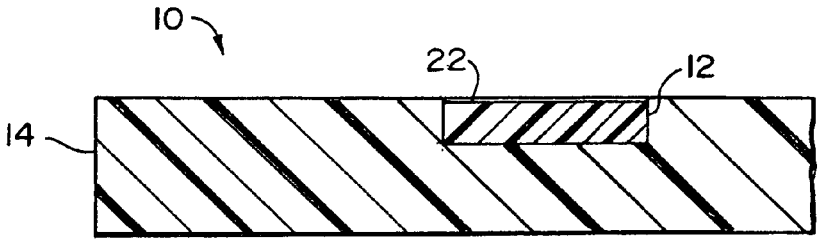
FIG. 2 is an enlarged sectional fragmentary view of the plate of FIG. 1 taken along line 2-2 and looking in the direction of the arrows.

There also may be provided a member 16 (shown sectioned in FIG. 2 and in plan view in FIG. 1) having visible indicia thereon. The member 16 is so dimensioned as to be easily insertable and into and removable from the groove 12. The member 16 may be comprised of a single member. The member 16 may be formed of a rigid material, such as a rigid plastic, porcelain, metalized plastic, hard rubber, or metal.

Figure 3:
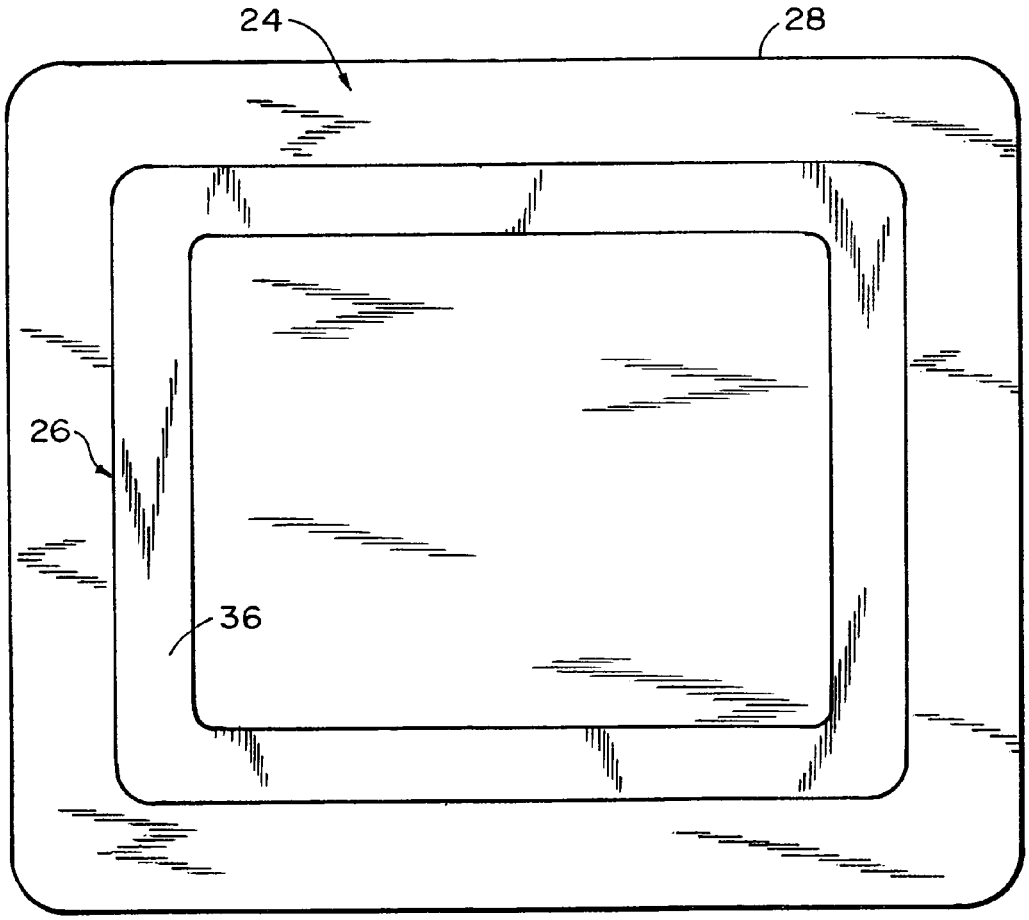
FIG. 3 is a top plan view of another plate.

In another example of a dish, a plate 24 (FIG. 3) may have a generally rectangular shape. As above, groove 26 may be spaced from and proximate to by spaced from the outer marginal edge 28 of the plate 24. As with the circular plate 12, the rigid member 36 is likewise easily insertable and removable from the groove 26.

The same concept may be applied to other types of dishes, such as, for example, a soup bowl, salad plate, or the like.

When viewed as an integral part of a table setting, the member 16 may be decorated with any suitable design theme such as, for example, Christmas wreathes for a Christmas celebration and may be opaque. The material and color of the insertable and removable members 16 may match the materials from which the dishes 10, 24 are made so as to aid the eye as viewing the combination as an integral part of the plate to which they are secured (see, e.g., FIG. 2).

In another example of a dish, the plate 24 (FIG. 3) may have a generally rectangular shape. The groove 26 may be spaced from and proximate to the outer marginal edge 28 of the plate 24. As with the circular plate 12, the flexible member 36 is likewise easily insertable and removable from the groove 26.

Figure 4:
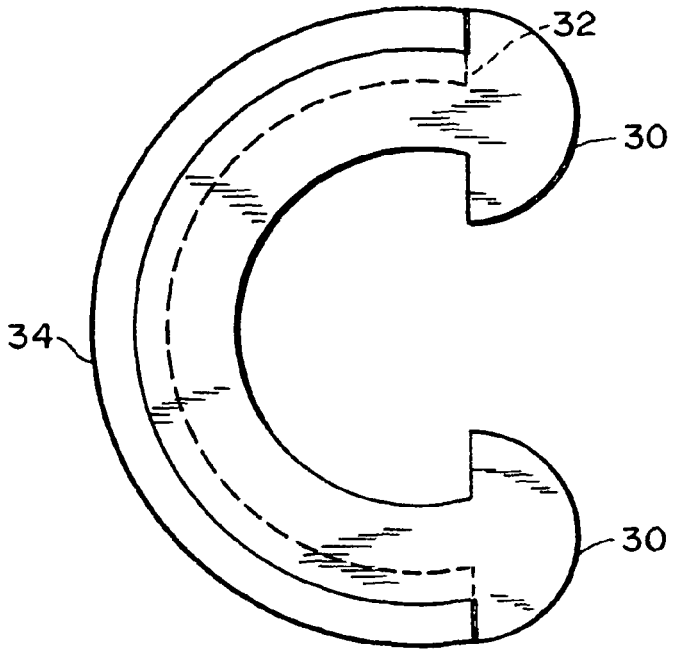
FIG. 4 is a side view of a spring clip or napkin ring.

There may be provided two examples of plates 30, 30' which, as shown, may be charger plates and presented in the plan top view (FIG. 4), have the same appearance. Although shown as a charger plate, as discussed below, this configuration is intended for all plates, napkin rings and the like. Thus, wherever the term "charger" is used, it is an example and not intended to limit the type of plate to be used.

Charger plates are larger plates usually characterized by a borders having indicia thereon which may be a single color or more complex designs. Charger plates are often used to dress up tables at parties, weddings, and other special events or in general usage. As a general standard of etiquette, food is usually not served on chargers. For this reason they are sometimes called under plates or chop plates. A charger plate has, relative to the size of a place setting the above-mentioned colorful and/or decorative marginal borders so as to set off the setting which may be disposed thereon or, even without a place setting, generally provide a pleasing appearance. While one may certainly eat using a charger plate, the are generally removed when the meal begins.

Figure 5:
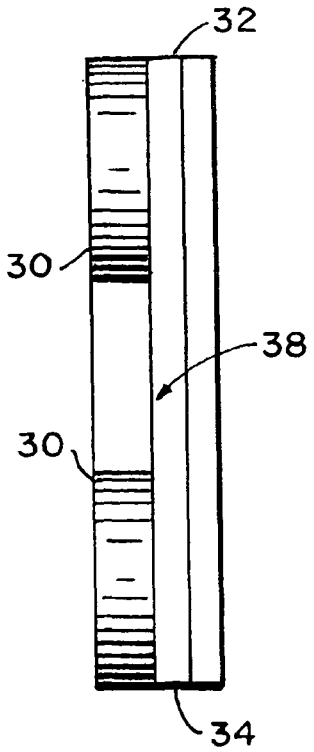
FIG. 5 is an end view of the spring clip or napkin ring of FIG. 4.

In this example, as is well known, the charger plate 30, 30' may be provided with a shallow upper surface concavity 32 which curves upwardly to the plate's 30, 30' rim-like section or flange 34, 34'. The rim-like section or flange 34, 34' of the plate may extend laterally parallel the plate 30, 30' of the base 32 or be curved or canted at an acute angle with respect thereto, or may have other shapes as are well known. This rim-like section or flange 34, 34' (referred to herein after jointly as "flange") may have therein a depression, track, or race 36 (referred to jointly hereinafter as the "race"). The race 36 is defined by a pair the interior and opposed side walls 38, 38' and 40, 40' integrally joined to a substantially planar base wall 42 (FIGS. 5*a*, 5*c*). The exterior wall or outer surface 44, 44' is integrally formed with the exterior wall 46, 46' of the flange bottom. Removably insertable in to the depression or race 36, 36' may be a member 48 which is decorative and thin (when compared to the height of the outer edge surface 44, 44' of the plate 30, 30"). As with the member previously described, the member is opaque and resists being permanent distorted. This member 48 may be made of plastic, metal, or similar materials. Where the member is to be disposed on a bowl, cup, or the like the same relative structures are used as more fully described below.

Figure 6:
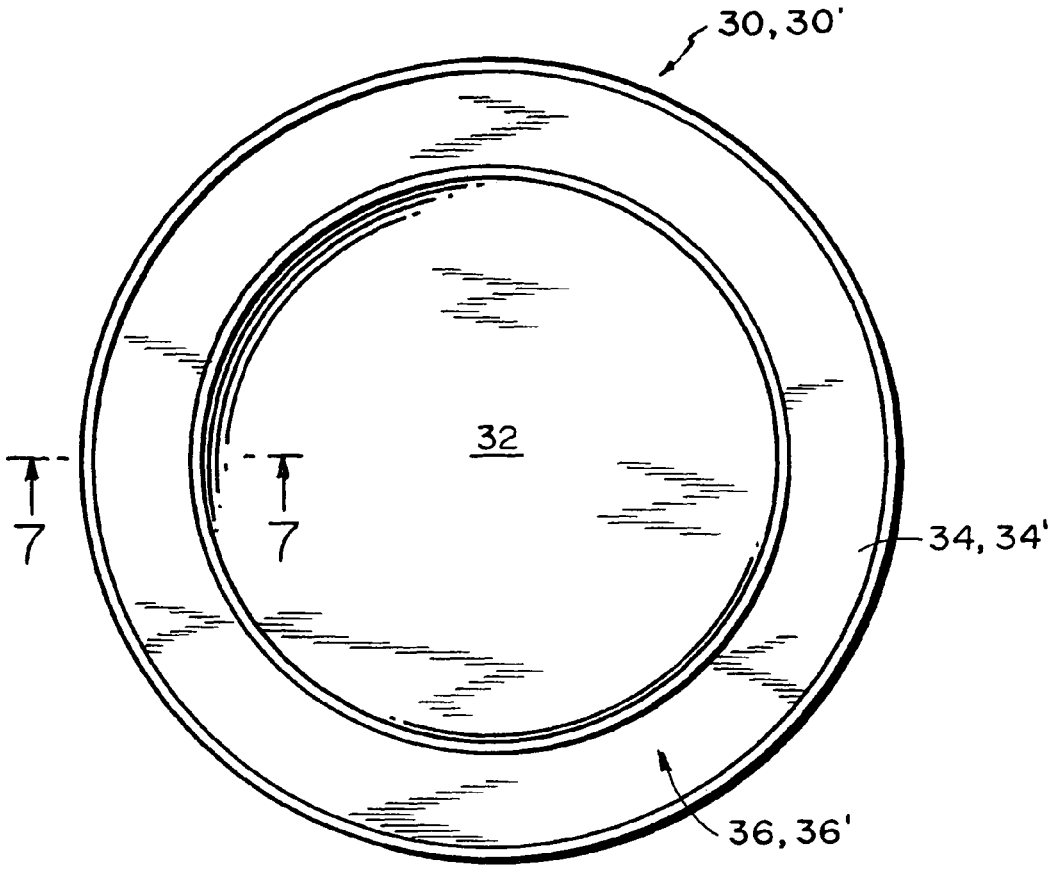
FIG. 6 is a top plan view of another plate.
Figure 7A:
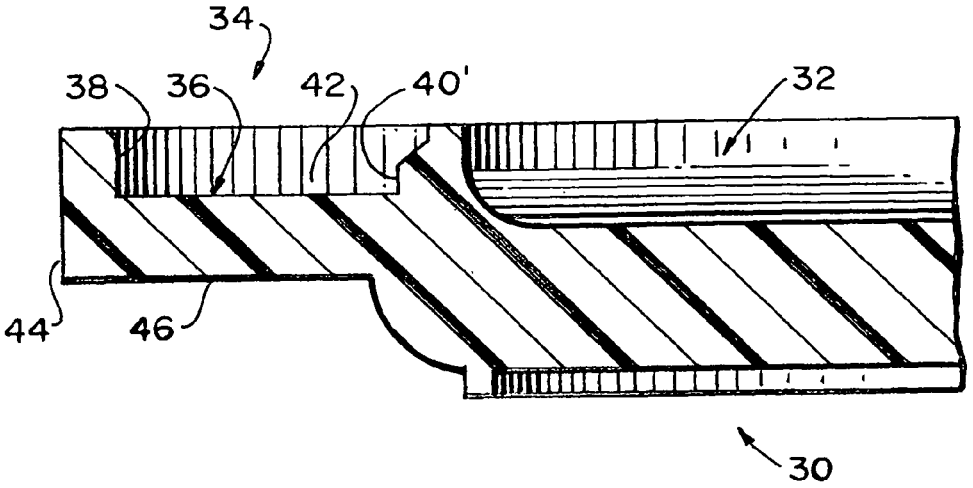
FIG. 7*a* is a sectioned, enlarged and fragmentary view showing the of the plate of FIG. 6 taken along line 7-7 and looking in the direction of the arrows.
Figure 7B:
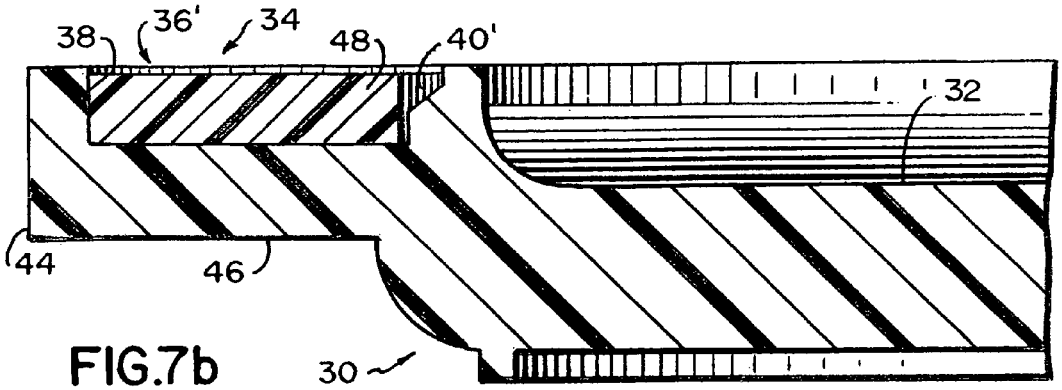
FIG. 7*b* is an enlarged sectional fragmentary view of another example of the plate of FIG. 6 taken along line 7-7 and looking in the direction of the arrows.
Figure 7C:
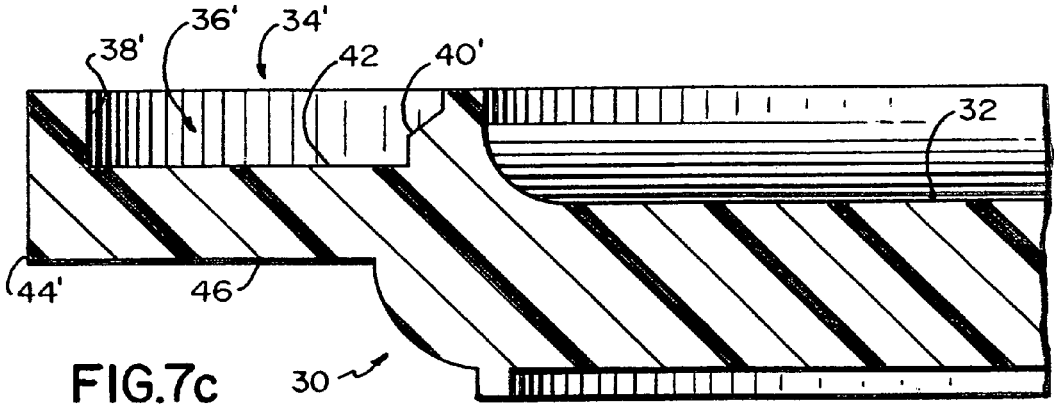
FIG. 7*c* is enlarged sectional fragmentary view of yet another example of the plate of FIG. 6 taken along line 7-7 and looking in the direction of the arrows.
Figure 7D:
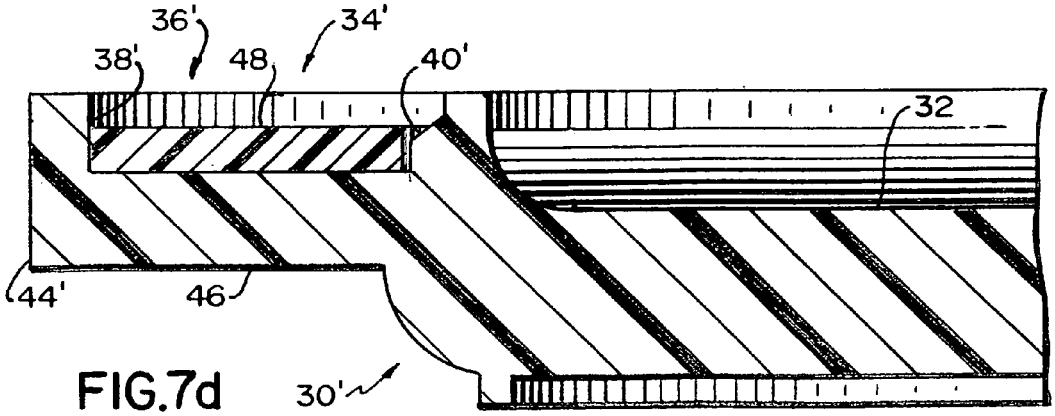
FIG. 7*d* is enlarged sectional fragmentary view of still another example of the plate of FIG. 6 taken along line 7-7 and looking in the direction of the arrows.
Figure 8:
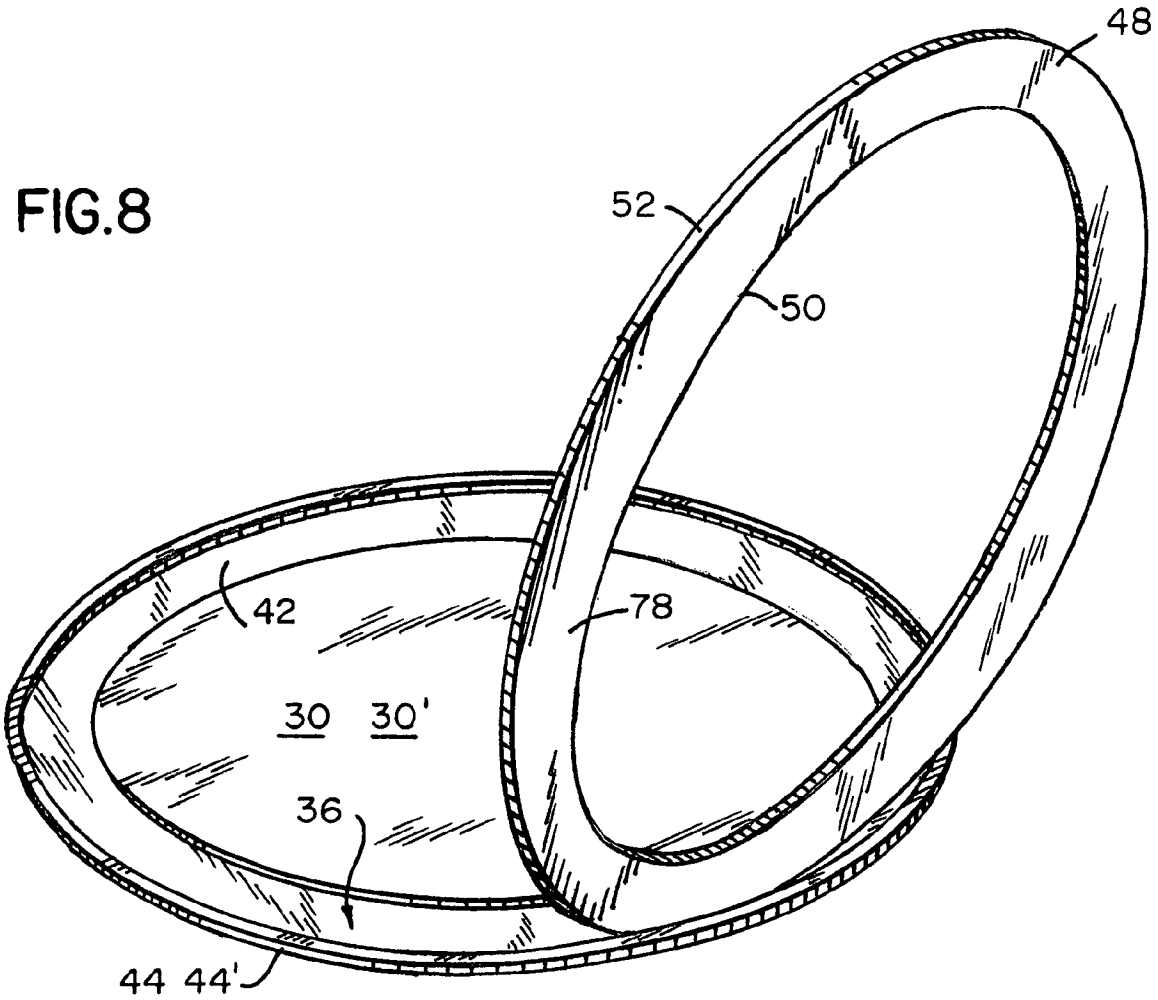
FIG. 8 is a perspective view of the plate with the member in a partially raised position.
Figure 9:
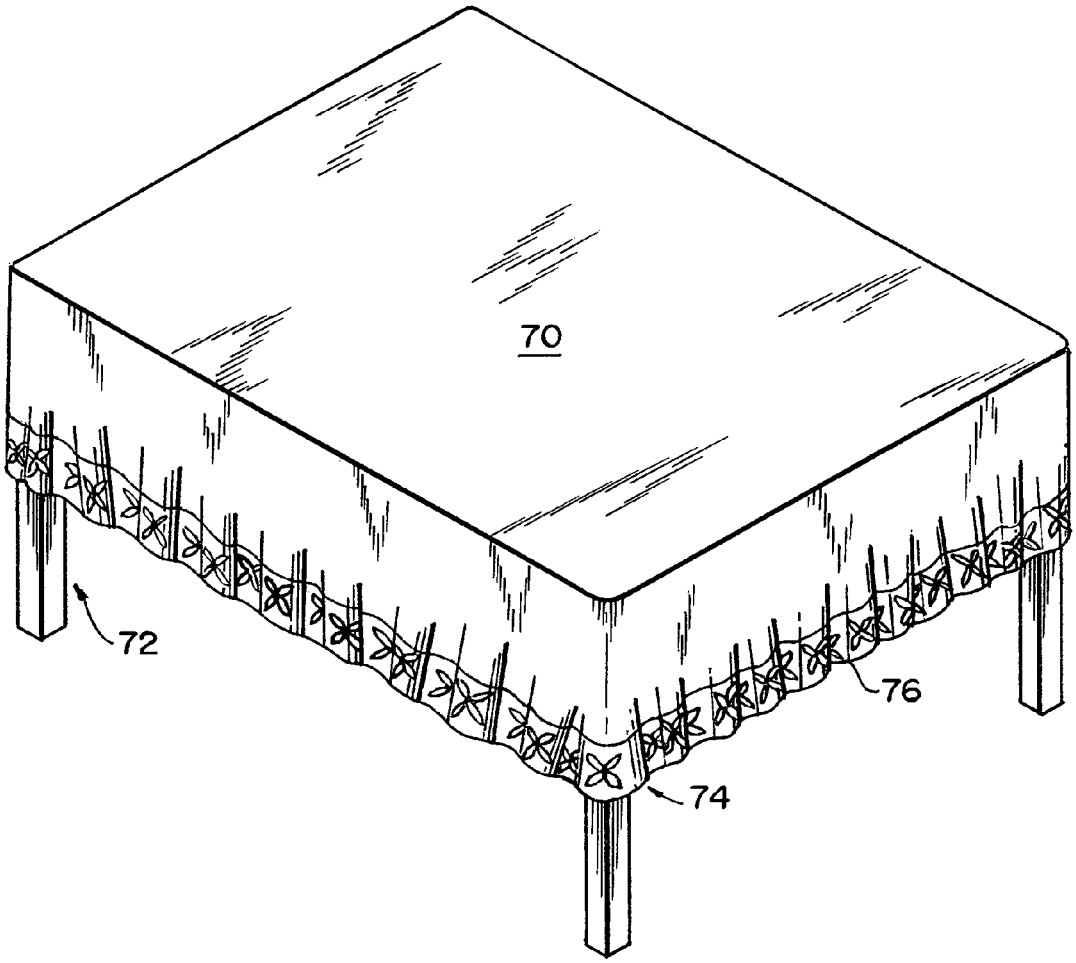
FIG. 9 is a perspective view of a dinning table with a tablecloth thereon.

In the example provided here (FIGS. 6, 8) the plate 30, 30' is circular and the member 48 and the race 42 are each in the shape of annulus and so dimensioned that the member 48 fits snugly but easily removably within the race 36. The member 48 may have an exceedingly thin edge 52 (FIG. 6) between the opposed decoratable surfaces 50 (only one side is visible in FIG. 6) so as to fit with the race 36 and have its upper surface between continuous with the upper surface of the plate. The shape of the track and corresponding shape of the member need not be an annulus. Any shape which conforms to the outer dimensions of the plate (e.g., oval or rectangular) may be used.

In one example (FIGS. 5*a*, 5*b*) the interior side walls 38 and 40 may be equal in height from the bottom wall 42 of the race 36.

In the other example (FIGS. 5*c*, 5*d*) the interior side wall 38' may extend to a slightly greater height form the bottom wall of the race 36.

The race 36 may be disposed proximate the marginal edge 44, 44' of the plate such that the race 36 describes an border to the plate 30, 30' thereby coursing about and proximate the outer edge wall 44, 44'.

The exposed surface 50 of the member 48 (whether an annulus or some other predetermined shape) may have indicia such as a different color and/or decoration.

In use, the upper or exposed surface of the member 48 is, along its interior marginal edge 50 substantially flush with the upper surface 32 of the charger plate 30, 30' so that it gives the appearance of being unitary with the plate's rim 30, 30'. In addition, the fit is such as to retard the migration of food into the race 36. Further, the member 48 may have, as indicated, indicia which may be differing colors and/or designs on opposed sides so as to selectively present a different appearance for such that one member may be used on two occasions. Thus, for example, a user may change the color of the plate to match or contrast with the table line or, perhaps, with Christmas or other holiday decorations, and the like. In addition, a number of sets of members 48 may be provided to give the user a wide selection. The member 48 can be easily removed from or disposed within the race. The upper and opposed lower decorative surface 78 (only the upper decorative surface is shown)

The same concept may be applied to other types of dishes, such as, for example, a soup bowl, salad plate, or the like. The same combination may be provided in the context of a napkin ring or a spring clip for holding a table cloth to a table (not shown). In the example presented, a napkin ring 60 (FIGS. 4 and 5) may be formed with a groove 62. A member 64 may be removably inserted within the groove 62.

In addition a table cloth 70 may be disposed on a typical table 72. The hem 74 may have attached thereto a decorative and removable panel 76. The panel 76 is removable from the table cloth 70 and may be decorated with a design to match or enhance the design upon the exposed surfaces 22, 36, 68, 78 of the members 16, 36, 64, 78. The panel 76 may be releasably secured to the tablecloth by any securing means such as snaps, buttons, Velcro® or the like (attachments not visible). The tablecloth 70 to which may be attached along the exposed border a removable themed print. This themed print may be attached by any known closure means, such as Velcro® or buttons.

When viewed as an integral part of a table setting system, the exposed upper surface 22, 36, 68, 78 (and panel 76) of the members 16, 36, 64, 78 and panel 76 may be decorated on opposed sides with any suitable design themes such as, for example, Christmas wreathes for a Christmas celebration and for an Easter celebration on the other side. Solid colors may also be used. The color of the insertable and removable members 16, 36, 64, 78 (and panel 76) may match the materials from which the dishes 10, 24, 30 (together with the panel 76) are made so that the members form, to the eye, an inseparable part of the table setting element to which they are secured.

The members 16, 36, 64, 78 are so dimensioned as to be flush with the table setting element into which they are inserted so as to enhance the uniform appearance. In addition, the flush fit helps insure that food does not become lodged visibly by the members so as to be unsightly and unhealthy.

What is claimed is:

1. A set of plates comprising:

a plurality of plates, each having an exposed upper surface;

a groove within each plate in the exposed upper surface of the plate;

a first set of a plurality of removable members, each member dimensioned to be inserted in the groove in each plate, to fit securely therein and substantially flush with the upper surface of each plate;

wherein each of the members of the first set of the plurality of removable members has an upper surface having a substantially similar first indicia thereon, each of the first indicia being visible when positioned in the groove such that the plurality of plates appear similar thereto due to the substantially similar indicia, creating a first design theme for the plurality of plates; and at least a second set of a plurality of removable members, each member dimensioned to be inserted in the groove in each plate, to fit securely therein, and substantially flush with the upper surface of each plate;

wherein each of the members of the second set of the plurality of removable members has an upper surface having a substantially similar second indicia thereon, the second indicia being different than the first indicia, each of the second indicia being visible when positioned in the groove such the plurality of plates appear similar thereto due to the substantially similar second indicia thereon, creating a second design theme of the plurality of plates that differs from the first design theme; and wherein the first design theme or the second design theme of the set of plates may be selectively determined by inserting each of the first set of removable members in the groove of each plate or the second set of removable members in the groove of each plate.

2. The set of plates of claim 1, wherein each of the plurality of plates is substantially circular and the groove therein forms a border being adjacent and uniformly spaced from an outer marginal edge of the plate.

3. The set of plates of claim 1, wherein the groove in each of the plurality of plates is within a portion of the plate where food is placed thereon.

4. The set of plates of claim 1, wherein each of the plurality of plates is substantially circular and the groove therein is a within a portion of the plate where food is placed thereon.

* * * * *